US011591995B2

(12) United States Patent
Brown et al.

(10) Patent No.: US 11,591,995 B2
(45) Date of Patent: Feb. 28, 2023

(54) FUEL INJECTOR HAVING VALVE SEAT ORIFICE PLATE WITH VALVE SEAT AND DRAIN AND RE-PRESSURIZATION ORIFICES

(71) Applicant: Caterpillar Inc., Peoria, IL (US)

(72) Inventors: Cory Andrew Brown, Peoria, IL (US); Matthew Robert Vanderveen, Gridley, IL (US); Andrew Justin Wallis, Pontiac, IL (US); Michael Curtis Herr, Tremont, IL (US); Dana Ray Coldren, Secor, IL (US)

(73) Assignee: Caterpillar Inc., Peoria, IL (US)

( * ) Notice: Subject to any disclaimer, the term of this patent is extended or adjusted under 35 U.S.C. 154(b) by 16 days.

(21) Appl. No.: 17/021,461

(22) Filed: Sep. 15, 2020

(65) Prior Publication Data

US 2022/0082073 A1 Mar. 17, 2022

(51) Int. Cl.

| | |
|---|---|
| ***F02M 61/04*** | (2006.01) |
| ***F02M 51/06*** | (2006.01) |
| ***F02M 55/00*** | (2006.01) |
| ***F02M 61/18*** | (2006.01) |

(52) U.S. Cl.

CPC ..... *F02M 61/04* (2013.01); *F02M 51/06* (2013.01); *F02M 61/1806* (2013.01); *F02M 61/1886* (2013.01); *F02M 2200/858* (2013.01)

(58) Field of Classification Search

CPC ..... F02M 61/04; F02M 61/1806; F02M 61/1886; F02M 51/06; F02M 2200/858; F02M 47/027

See application file for complete search history.

(56) References Cited

U.S. PATENT DOCUMENTS

| | | | | |
|---|---|---|---|---|
| RE19,367 | E * | 11/1934 | Katzman | A61L 9/14 392/335 |
| 4,540,155 | A | 9/1985 | Redston | |
| 4,561,632 | A | 12/1985 | Hugler | |
| 4,605,197 | A | 8/1986 | Casey et al. | |
| 4,765,587 | A | 8/1988 | Cummins | |
| 4,840,193 | A | 6/1989 | Schiel | |
| 5,676,114 | A | 10/1997 | Tarr et al. | |
| 6,056,264 | A | 5/2000 | Benson et al. | |
| 6,286,768 | B1 | 9/2001 | Vetters et al. | |
| 6,520,144 | B2 | 2/2003 | Shiraishi et al. | |
| 6,755,353 | B2 | 6/2004 | Lorraine et al. | |

(Continued)

FOREIGN PATENT DOCUMENTS

| | | |
|---|---|---|
| CN | 105579699 A | 5/2016 |
| DE | 202016002391 U1 | 6/2016 |

(Continued)

*Primary Examiner* — Joseph A Greenlund

(74) *Attorney, Agent, or Firm* — Brannon Sowers & Cracraft PC

(57) ABSTRACT

A fuel injector includes an injector housing, an outlet check, an injection control valve assembly, and a valve seat orifice plate integrating a valve seat and various orifices for outlet check control. In the valve seat orifice plate a drain orifice extends between a valve seat surface and a check control chamber formed between a closing hydraulic surface of the outlet check and the valve seat orifice plate. First and second re-pressurization orifices extend between an outer surface of the valve seat orifice plate and the check control chamber.

19 Claims, 5 Drawing Sheets

(56) References Cited

U.S. PATENT DOCUMENTS 8,448,878 B2 * 5/2013 Ibrahim ..... F02M 47/027 239/533.8
8,505,514 B2 * 8/2013 Fang ..... F02M 47/027 123/445
8,590,513 B2 11/2013 Kondo et al.
8,596,561 B2 * 12/2013 Kim ..... F02D 19/0694 239/584
8,690,075 B2 * 4/2014 Mahmood ..... F02M 47/027 239/533.8
9,016,603 B2 * 4/2015 Holtman ..... F02M 63/0075 239/96
9,453,483 B2 * 9/2016 Kim ..... F02M 63/0019
9,695,789 B2 * 7/2017 Tanada ..... F02M 63/0026
11,174,827 B1 * 11/2021 Tatikonda ..... F02M 61/14
11,248,575 B1 * 2/2022 Lewis ..... F02M 61/14
2005/0224598 A1 * 10/2005 Potz ..... F02M 45/00 239/88
2007/0170286 A1 7/2007 Boecking
2009/0145404 A1 * 6/2009 Heinz ..... F02M 63/0031 123/456
2009/0314860 A1 * 12/2009 Wang ..... F02M 45/08 239/585.1
2011/0168813 A1 * 7/2011 Bunni ..... H01F 7/1638 239/585.4
2011/0220064 A1 * 9/2011 Fang ..... F02M 47/027 123/445
2012/0042852 A1 * 2/2012 Yamada ..... F02M 47/025 123/445
2012/0103308 A1 * 5/2012 Hefler ..... F02M 63/0077 239/584
2012/0111965 A1 * 5/2012 Ibrahim ..... F02M 47/027 239/533.7
2012/0152206 A1 * 6/2012 Adachi ..... F02M 61/168 123/445
2012/0291753 A1 * 11/2012 Hefler ..... F02M 47/027 123/456
2013/0112767 A1 * 5/2013 Mahmood ..... F02M 55/008 239/11
2014/0131483 A1 * 5/2014 Adachi ..... F02M 47/027 239/584
2014/0174405 A1 * 6/2014 Adachi ..... F02M 63/0054 123/472
2014/0203112 A1 * 7/2014 Holtman ..... F02M 47/027 239/585.1
2015/0008271 A1 * 1/2015 Mack ..... F02M 61/168 29/428
2019/0063386 A1 * 2/2019 Brown ..... F02M 51/0628
2020/0263644 A1 * 8/2020 Benson ..... F02M 61/1806
2022/0082073 A1 * 3/2022 Brown ..... F02M 61/1806
2022/0163009 A1 * 5/2022 Tower ..... F02M 61/165
2022/0282692 A1 * 9/2022 Bannur Nagaraja ..... F02M 61/165

FOREIGN PATENT DOCUMENTS

DE 102016004584 B4 6/2018
KR 101784976 B1 10/2017

* cited by examiner

FUEL INJECTOR HAVING VALVE SEAT ORIFICE PLATE WITH VALVE SEAT AND DRAIN AND RE-PRESSURIZATION ORIFICES

TECHNICAL FIELD

The present disclosure relates generally to a fuel injector for an internal combustion engine, and more particularly to a valve seat orifice plate integrating a valve seat and drain and re-pressurization orifices in a single component.

BACKGROUND

Many modern internal combustion engines, notably compression-ignition engines, employ a highly sophisticated electronically controlled fuel system including fuel injectors having direct-operated outlet checks. The direct-operated outlet check will typically include a closing hydraulic surface exposed to fluid pressure in a control chamber. Pressure is relieved in the control chamber to initiate an injection event, and restored to the control chamber to end fuel injection. Various orifices are conventionally used in an orifice plate to control, or assist in controlling, the variations in pressure in the control chamber to optimally actuate the outlet check. A control valve is employed to selectively connect the control chamber to low pressure.

Engineers have experimented in many ways over the years with the arrangement and sizing of the various orifices in the orifice plate. In one known system, the control chamber is supplied with pressurized fuel by way of a so-called "Z-orifice" in an orifice plate, and connected to low pressure by way of a so-called "A orifice" in a piece separate from the orifice plate. An "F-orifice" is employed in some systems to assist, along with the Z-orifice, in re-pressurizing the control chamber. Various different operational and performance characteristics can be obtained by varying the use, arrangement, and geometry of the various orifices. U.S. Pat. No. 8,448,878 to Ibrahim et al. is directed to a fuel injector with needle control system that includes F, A, Z, and E orifices. The disclosure in Ibrahim et al proposes a common rail fuel injector employing the various orifices, and teaches different performance characteristics that can be achieved by adjusting their respective sizes.

SUMMARY OF THE INVENTION

In one aspect, a fuel injector includes an injector housing defining a longitudinal axis and having formed therein a fuel inlet, a fuel drain outlet, a nozzle cavity fluidly connected to the fuel inlet, and a plurality of nozzle outlets. The fuel injector also includes an outlet check movable from a closed position blocking the plurality of nozzle outlets from the nozzle cavity, to an open position, and having a closing hydraulic surface. The fuel injector further includes a valve seat orifice plate including a first axial side having a valve seat surface, a second axial side, and an outer surface axially between the first axial side and the second axial side and exposed to a fluid pressure of the fuel inlet. The valve seat orifice plate further includes a drain orifice extending between the valve seat surface and a check control chamber formed between the closing hydraulic surface and the second axial side, and a first re-pressurization orifice and a second re-pressurization orifice each extending between the outer surface and the check control chamber. The fuel injector still further includes an injection control valve assembly having an electrical actuator, an armature, and an injection control valve movable from a closed position in contact with the valve seat surface, to an open position fluidly connecting the drain orifice to the fuel drain outlet.

In another aspect, a valve seat orifice plate for a fuel injector includes a valve seat body defining a center axis, and including a centrally located drain orifice extending between a first axial side and a second axial side of the valve seat body. The valve seat body further includes a valve seat surface formed on the first axial side and extending circumferentially around the center axis and radially outward of the centrally located drain orifice, and a plurality of flow slots distributed circumferentially around the center axis and extending radially outward of the valve seat surface. The valve seat body further includes a profiled sealing surface formed on the first axial side and extending circumferentially around the center axis at a location radially outward of the plurality of flow slots, an outer surface extending between the first axial side and the second axial side, and a planar check-facing surface formed on the second axial side and structured to form a wetted wall of a check control chamber in the fuel injector. The valve seat body further includes a re-pressurization orifice extending between the outer surface and the planar check-facing surface and positioned to refill the check control chamber.

In still another aspect, a method of operating a fuel injector includes moving a control valve in an electrically actuated control valve assembly in the fuel injector from a closed position, in contact with a valve seat of a valve seat orifice plate, to an open position. The method further includes fluidly connecting a check control chamber in the fuel injector to a fuel drain outlet of the fuel injector by way of a drain orifice extending through the valve seat orifice plate, based on the moving of the control valve to the open position. The method further includes moving an outlet check in the fuel injector from a closed position to an open position, where nozzle outlets in the fuel injector are fluidly connected to a nozzle cavity, to spray a fuel from the nozzle outlets, based on the fluidly connecting of the check control chamber to the fuel drain outlet. The method still further includes returning the control valve to the closed position, returning the outlet check to the closed position, and re-pressurizing the control chamber with flows of fuel through a first re-pressurization orifice and a second re-pressurization orifice each extending between an outer surface of the valve seat orifice plate and the check control chamber.

DETAILED DESCRIPTION

Figure 1:
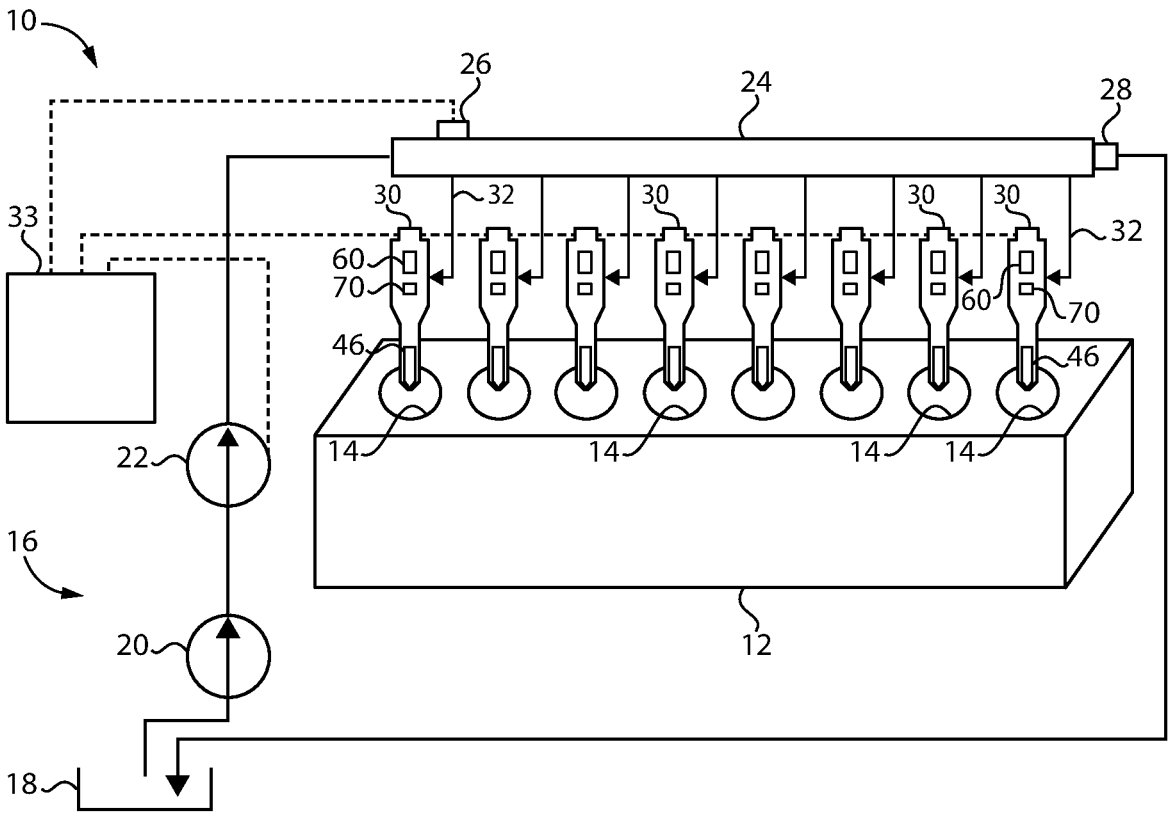
FIG. 1 is a diagrammatic view of an internal combustion engine system, according to one embodiment.

Referring to FIG. 1, there is shown an internal combustion engine system 10, according to one embodiment. Internal combustion engine system 10 includes an engine housing 12 having a plurality of combustion cylinders 14 formed therein. Engine housing 12 can include any number of cylinders in any suitable arrangement. Engine system 10 also includes a fuel system 16 having a fuel tank 18, a low pressure pump 20, a high pressure pump 22, and a pressurized fuel reservoir 24. A pressure sensor 26 may be coupled with pressurized fuel reservoir 24. A pressure relief valve 28 is provided to limit excess fuel pressure, and for returning drained fuel to fuel tank 18. Fuel system 16 also includes a plurality of fuel injectors 30. Each of fuel injectors 30 may be coupled to pressurized fuel reservoir 24 by way of a fuel feed line 32, such as a so-called quill connector or any other suitable feed line. Pressurized fuel reservoir 24 can include a single monolithic fuel reservoir, connected to all of fuel injectors 30, or a plurality of separate pressurized fuel reservoirs or accumulators each coupled to one or more of fuel injectors 30. Fuel injectors 30 may be similar or identical, and each includes an outlet check 46, an electrically actuated control valve assembly 60, and a valve seat orifice plate 70, features and functionality of which will be further apparent from the following description. Engine system 10 also includes an electronic control unit 33, such as an engine control unit or a dedicated fueling control unit, in communication with high pressure pump 22, pressure sensor 26, and fuel injectors 30 for purposes that will be understood by those skilled in the field of fuel systems.

Figure 2:
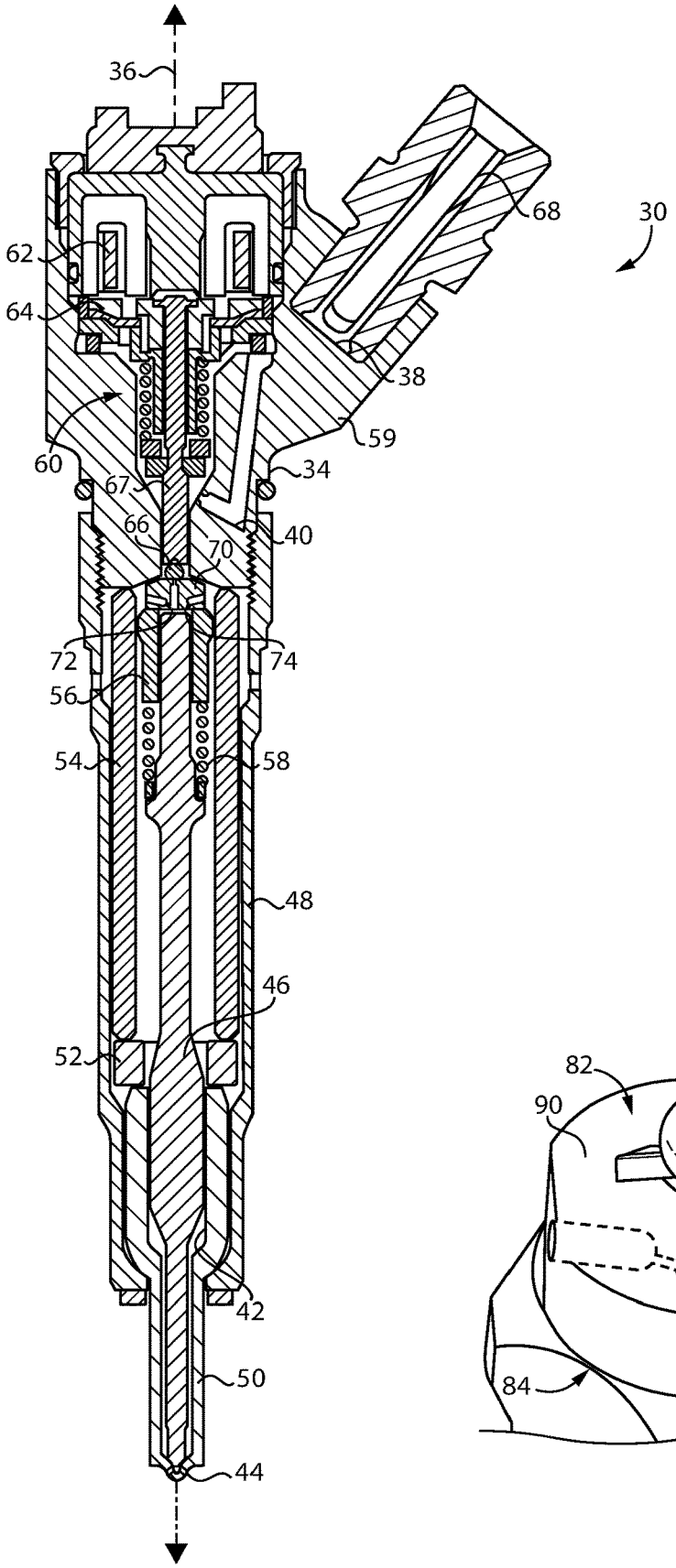
FIG. 2 is a sectioned side diagrammatic view of a fuel injector, according to one embodiment.

Referring also now to FIG. 2, there are shown additional features of one of fuel injectors 30 in further detail. Each of fuel injectors 30, hereinafter referred to in the singular, includes an injector housing 34 defining a longitudinal axis 36 and having formed therein a pressurized fuel inlet 38, a fuel drain outlet 40, a nozzle cavity 42 fluidly connected to fuel inlet 38, and a plurality of nozzle outlets 44. Fuel injector 30 also includes an outlet check 46 as noted above, movable from a closed position blocking nozzle outlets 44 from nozzle cavity 42, to an open position. Outlet check 46 includes a closing hydraulic surface 72. Also shown in FIG. 2 are additional features of fuel injector 30, including a nozzle case 48, a tip piece 50 having nozzle outlets 44 formed therein, a first stack piece 52, and a second stack piece 54, clamped between an injector body piece 59 attached to nozzle case 48 and tip piece 50. Outlet check 46 is guided by a guide sleeve 56 positioned in stack piece 54, and outlet check 46 is biased toward its closed position by way of a biasing spring 58. A fuel filter 68 filters fuel from an associated one of fuel feed lines 32 supplied to fuel inlet 38. Fuel drain outlet 40 may fluidly connect between and amongst components of injector housing 34 to fluidly connect with a source of low pressure, internally of fuel injector 30 or externally of fuel injector 30. Fuel injector 30 also includes an injection control valve assembly 60 having an electrical actuator 62 such as a solenoid, an armature 64, and an injection control valve 66. In the illustrated embodiment a rod piece 67, separate from control valve 66, is attached to armature 64. Control valve 66 is movable from a closed position in contact with valve seat orifice plate 70, to an open position to vary a fluid pressure in a check control chamber 74 in a manner further discussed herein.

Figure 3:
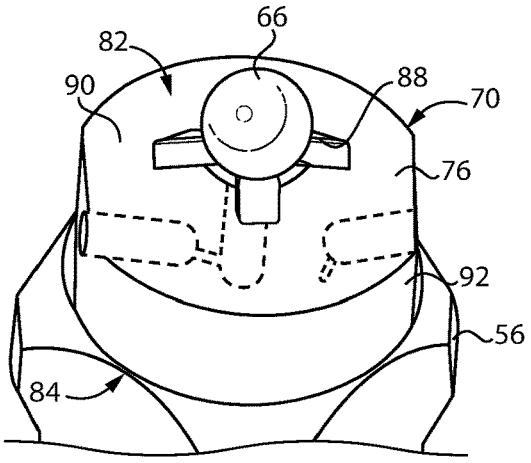
FIG. 3 is a diagrammatic view of a valve seat orifice plate and injection control valve, according to one embodiment.
Figure 4:
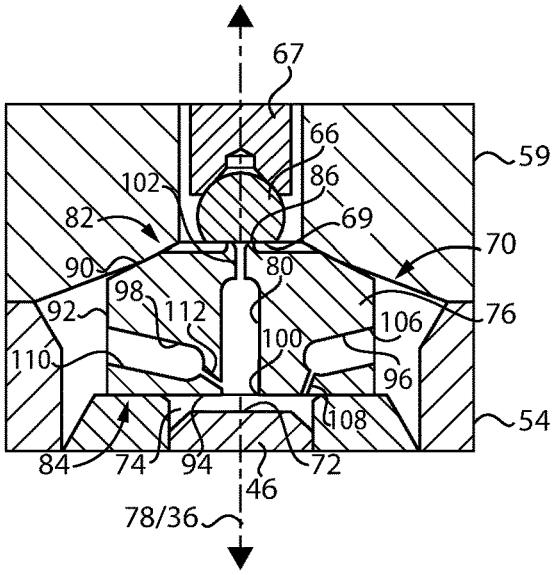
FIG. 4 is a sectioned view through a portion of the fuel injector of FIG. 2.
Figure 5:
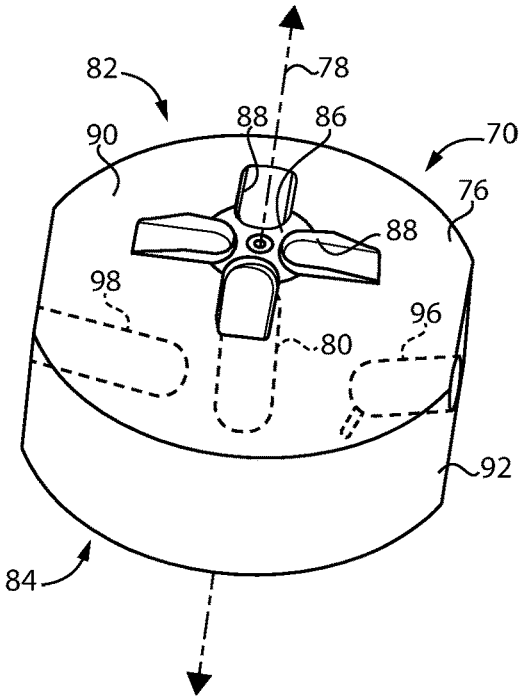
FIG. 5 is a diagrammatic view of a valve seat orifice plate, according to one embodiment.

Referring also now to FIGS. 3 and 4, valve seat orifice plate 70 includes a valve seat body 76 defining a center axis 78. When installed for service in fuel injector 30, center axis 78 may be colinear with longitudinal axis 36. Description herein of features of valve seat body 76 or valve seat orifice plate 70 should be understood to refer to either of these. Valve seat body 76 includes a drain orifice 80 which will typically be centrally located in valve seat body 76 and extends between a first axial side 82 and a second axial side 84 of valve seat body 76. Valve seat body 76 further includes a valve seat surface 86 that forms a valve seat, formed on first axial side 82. Valve seat surface 86 extends circumferentially around center axis 78 and radially outward of centrally located drain orifice 80. Valve seat body 76 also has formed therein a plurality of flow slots 88 distributed circumferentially around center axis 78 and each extending radially outward of valve seat surface 86. In the illustrated embodiment, flow slots 88 are relatively deeper radially inward and adjacent to valve seat surface 86, and relatively shallower at locations radially outward. Valve seat body 76 further includes a profiled sealing surface 90 formed on first axial side 82. When assembled for service in fuel injector 30 profiled sealing surface 90 abuts and fluidly seals, or substantially fluidly seals, against injector body piece 59. Profiled sealing surface 90 extends circumferentially around center axis 78 at a location radially outward of flow slots 88. Also in the illustrated embodiment, flow slots 88 may extend outwardly so as to interrupt a circumferential profile of profiled sealing surface 90. Profiled sealing surface 90 may be spherical in some embodiments, but could be conical or have a non-spherical curvilinear shape in other instances. Valve seat body 76 also includes an outer surface 92 located axially between first axial side 82 and second axial side 84, and typically extending from first axial side 82 to second axial side 84, facing a radially outward direction. Outer surface 92 may be formed so as to have two cylindrical surface segments alternating with two planar surface segments, as shown in FIG. 5, however, the present disclosure is not thereby limited. Valve seat body 76 also includes a planar check-facing surface 94 structured to form a wetted wall of check control chamber 74 when installed for service in fuel injector 30. Planar check-facing surface 94 is formed on second axial side 84, and may be positioned in contact with sleeve 56.

Figure 6:
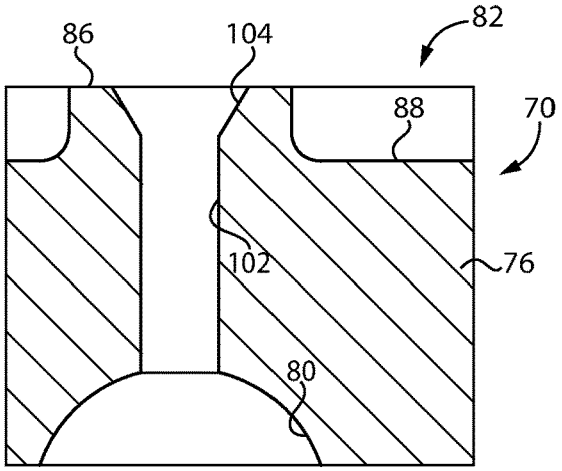
FIG. 6 is a sectioned side diagrammatic view through a portion of the valve seat orifice plate of FIG. 5.

Referring also to FIGS. 5 and 6, in addition to drain orifice 80, valve seat body 76 further includes a first re-pressurization orifice 96 and a second re-pressurization orifice 98. First re-pressurization orifice 96 and second re-pressurization orifice 98 each extend between outer surface 92 and check control chamber 74, and may each also be understood to extend between outer surface 92 and planar check-facing surface 94. First re-pressurization orifice 96 and second re-pressurization surface 98 may be positioned, respectively, to refill check control chamber 74 at a radially outward location and at a radially inward location, relative to center axis 78. It has been discovered that refilling check control chamber 74 at the end of or after a fuel injection event from two locations may provide certain advantages with respect to promoting "hovering" of outlet check 46 just adjacent to valve seat orifice plate 70, instead of making a hard stop, as well as lifting outlet check 46 from contact with valve seat orifice plate 70 if a hard stop does occur.

From the Figures, it can also be noted that drain orifice 80 includes an unrestricted inlet end 100 opening in planar check-facing surface 94, and a restricted outlet end 102. Unrestricted generally means larger with regard to flow area, as compared to a relatively smaller thus more restricted flow area. Outlet end 102 may be several times smaller in diameter than inlet end 100. It can also be seen from FIG. 6 that valve seat body 76 further includes a counterbore 104 formed in first axial side 82. Outlet end 102 opens to counterbore 104 in the illustrated embodiment, and valve seat surface 86 is flat and extends circumferentially around counterbore 104. Control valve 66 may include a flat-sided spherical ball valve, having a flat 69 in contact with valve seat surface 86 when control valve 66 is at the closed position. As can also be seen from FIG. 6, counterbore 104 may be conical. A conical shape to counterbore 104 can assist during manufacturing and tightly controlling a diameter of valve seat surface 86, and providing an optimized flow path over and around valve seat surface 86 into flow channels 88. In other embodiments, rather than a counterbore that is conical, a counterbore may be provided that has a straight-sided or curvilinear profile at least in part, as further discussed herein.

First re-pressurization orifice 96 includes an unrestricted inlet end 106 opening in outer surface 92, and a restricted outlet end 108 opening in planar check-facing surface 94. Second re-pressurization orifice 98 includes an unrestricted inlet end 102 opening in outer surface 92, and a restricted outlet end 112 opening to centrally located drain orifice 80, just adjacent to planar check-facing surface 94. It will be recalled that first re-pressurization orifice 96 is fluidly connected to check control chamber 74 at a location that is radially outward, relative to longitudinal axis 78 and center axis 36, and that second re-pressurization orifice 98 is fluidly connected to check control chamber 74 at a location that is radially inward, relative to longitudinal axis 78 and center axis 36.

Figure 7:
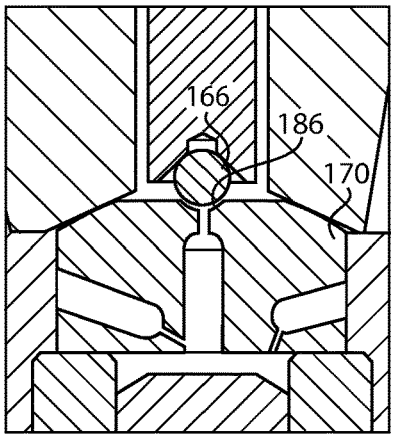
FIG. 7 is a sectioned side diagrammatic view through a portion of a fuel injector, including a valve seat orifice plate, according to another embodiment.

Referring to FIG. 7, there is shown a valve seat orifice plate 170 according to another embodiment. Valve seat orifice plate 170 includes a valve seat surface 186 that is conical, in contrast to the flat valve seat surface of the foregoing embodiment. Rather than a flat-sided ball valve, in the embodiment of FIG. 7 a spherical ball valve 166 is seated in the valve seat formed by valve seat surface 186. In some instances, desirable or improved flow characteristics might be observed with a sphere-in-cone arrangement as in FIG. 7, however, a flat seat arrangement as in the foregoing embodiment may be more robust against debris damage, for instance. Valve seat orifice plate 170 may include a drain orifice and re-pressurization orifices in the same or similar arrangement as such orifices in the foregoing embodiment.

Figure 8:
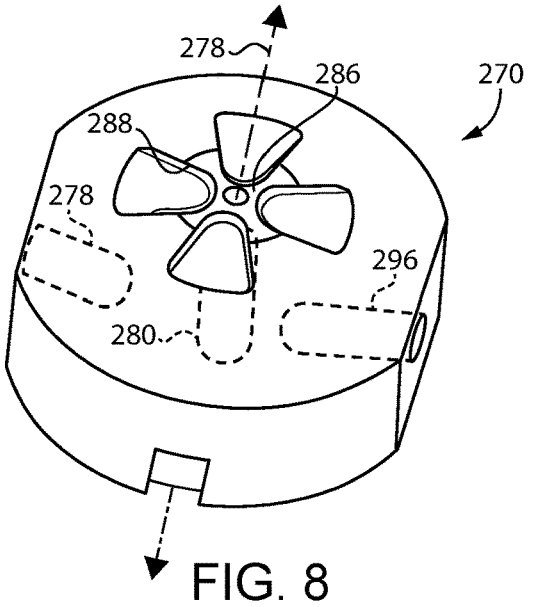
FIG. 8 is a diagrammatic view of a valve seat orifice plate according to another embodiment.
Figure 9:
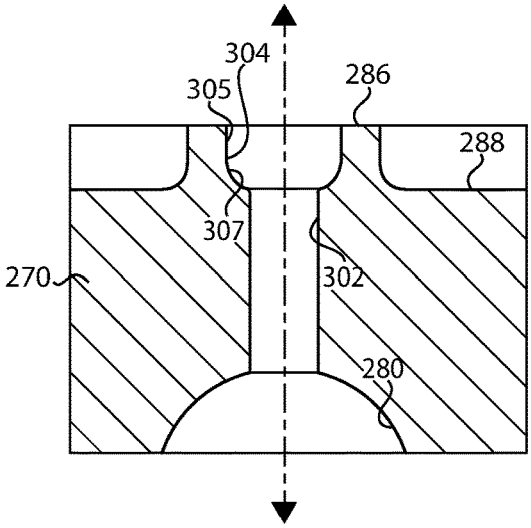
FIG. 9 is a sectioned side diagrammatic view through a portion of the valve seat orifice plate of FIG. 8.

Referring now to FIGS. 8 and 9, there is shown a valve seat orifice plate 270 according to another embodiment, and including a valve seat surface 286, and flow channels 288 distributed circumferentially around a center axis 278 of valve seat orifice plate 270, and extending radially outward. Valve seat orifice plate 270 may include a drain orifice 280, a first re-pressurization orifice 296, and a second re-pressurization orifice 298. Orifices 280, 296, and 298 may have a similar or identical arrangement and configuration as the respective orifices in the embodiment of FIGS. 4-6, and the embodiment of FIG. 7. It can be seen from FIG. 9 that drain orifice 280 may have a restricted outlet end 302 opening to a counterbore 304. Counterbore 304 may include a curvilinear surface or wall 307 adjacent to drain orifice 280, and transitioning by way of a cylindrical surface or wall 305 to valve seat surface 286. The profile of counterbore 304 may, in a longitudinal section plane as shown, be understood to have a bathtub shape.

Figure 10:
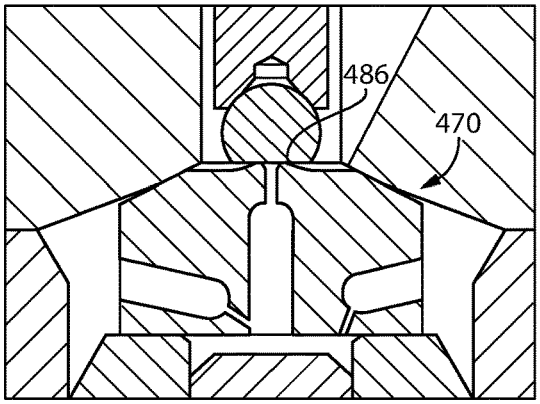
FIG. 10 is a sectioned side diagrammatic view through a portion of a fuel injector, including a valve seat orifice plate, according to yet another embodiment.
Figure 11:
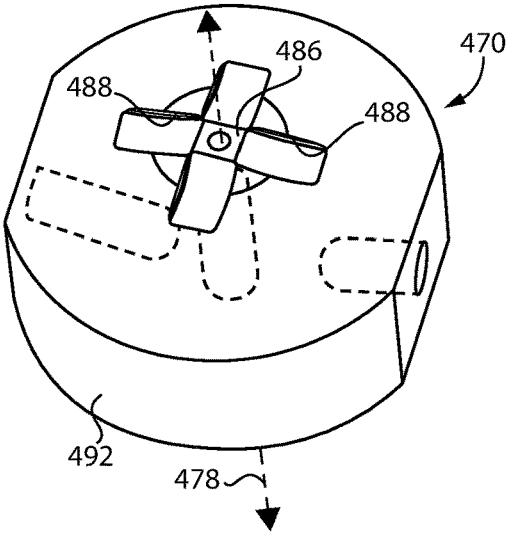
FIG. 11 is a diagrammatic view of the valve seat orifice plate of FIG. 10.
Figure 12:
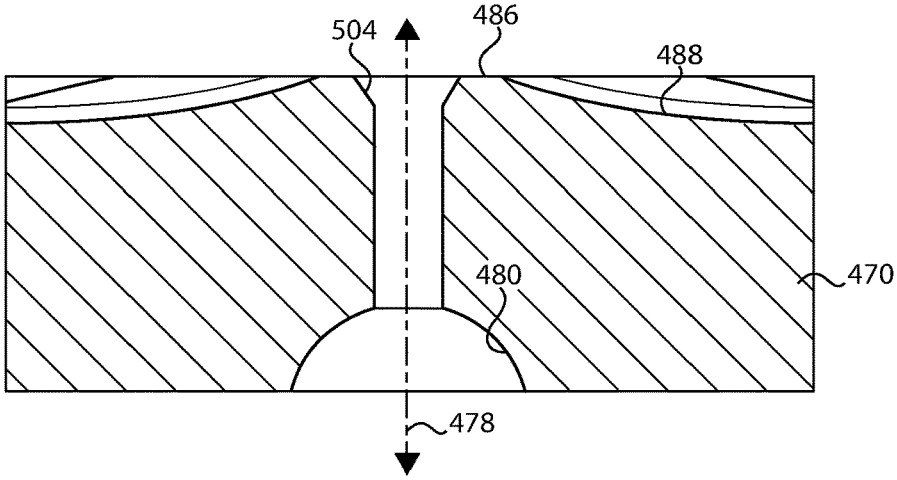
FIG. 12 is a sectioned side diagrammatic view through a portion of the valve seat orifice plate of FIG. 11.

Turning now to FIGS. 10-12, there is shown a valve seat orifice plate 470 according to yet another embodiment. Valve seat orifice plate 470 may again have a drain orifice and re-pressurization orifices similarly or identically arranged and configured to those of the preceding embodiments, however, the present disclosure is not thereby limited. Valve seat orifice plate 470 also includes a valve seat surface 486 and flow channels 488 distributed circumferentially around a center axis 478 of valve seat orifice plate 470. An outer surface 492 of valve seat orifice plate 470 may be oriented generally parallel to center axis 478, and flow channels 488 may have curved bottom or floor profiles, in a longitudinal section plane as best depicted in FIG. 12. Whereas flow channels in the preceding embodiments may have planar bottom surfaces, in valve seat orifice plate 470 geometry of flow channels 488 may provide advantages with respect to manufacturing, as a circular grinding disc can be readily used to form flow channels 488 in valve seat orifice plate 470. It can also be noted that flow channels 488 may be cut so as to form at least a center portion of valve seat surface 486 in a square configuration, as best depicted in FIG. 11.

Figure 13:
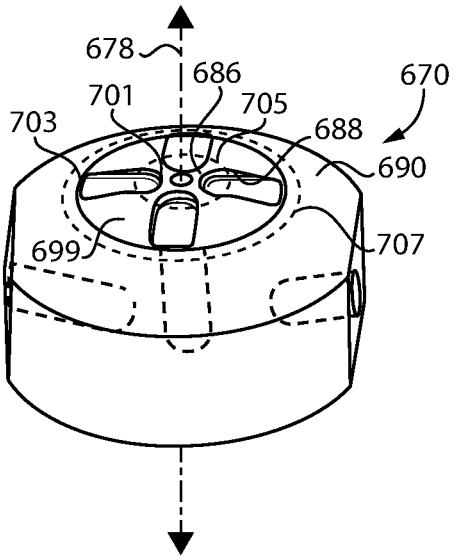
FIG. 13 is a diagrammatic view of a valve seat orifice plate, according to yet another embodiment.

Referring now to FIG. 13, there is shown a valve seat orifice plate 670 according to yet another embodiment. Valve seat orifice plate 670 may also include a drain orifice and re-pressurization orifices similarly or identically configured and arranged to preceding embodiments. Valve seat orifice plate 670 also includes a valve seat surface 686, and flow slots 688 distributed circumferentially around a center axis 678 and extending radially outward. Valve seat orifice plate 670 also includes a profiled sealing surface 690 that extends circumferentially around center axis 678 at a location spaced radially outward of flow slots 688.

Figure 14:
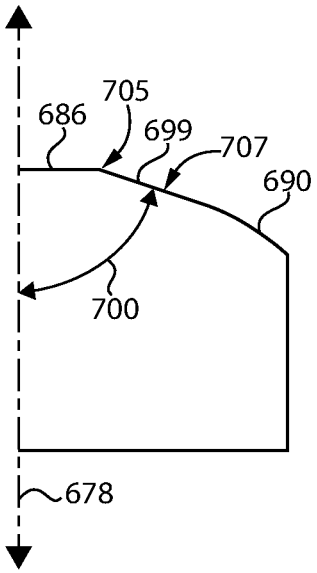
FIG. 14 is a diagrammatic profile view of a portion of the valve seat orifice plate of FIG. 13.

Valve seat orifice plate 670 also includes a conical transition surface 699 transitioning between valve seat surface 686 and profiled sealing surface 690, which may be spherical. Flow slots 688 extend radially outward from locations of origination 705 that are radially inward of conical transition surface 699, to locations of termination 703 that are radially inward of profiled sealing surface 690. In contrast to certain of the other embodiments described herein, profiled sealing surface 690 may be a continuous surface uninterrupted by flow slots. Referring also to FIG. 14, an inner circle is shown at 705 and identifies approximately where valve seat surface 686 intersects conical transition surface 699. An outer circle 707 is defined at a location where conical transition surface 699 intersects profiled sealing surface 690. Profiled sealing surface 690 may be a ground spherical radius surface, and as noted above can be uninterrupted circumferentially around center axis 678. An angle 700 is defined between center axis 678 and conical transition surface 705, and might be about 75° in one embodiment.

INDUSTRIAL APPLICABILITY

Referring to the drawings generally, but in particular reference to the embodiment of FIGS. 2-6, during operating internal combustion engine system 10 fuel injector 30 will be operated to inject a liquid fuel, for example diesel distillate fuel, one or more times into an associated combustion cylinder 30 during a conventional four stroke engine cycle. Operating fuel injector 30 to perform an injection includes moving control valve 66 in electrically actuated control valve assembly 60 in fuel injector 30 from a closed position, in contact with valve seat surface 86 (a valve seat) of valve seat orifice plate 70, to an open position. High pressure fuel is supplied from pressurized fuel reservoir 24 to fuel injector 30 such that high pressure fuel, prior to opening outlet check 46, resides in nozzle cavity 42, in control chamber 74, and elsewhere in fuel injector 30 including outside of and around valve seat orifice plate 70. As such, outer surface 92, closing hydraulic surface 72, and check-facing surface 94 are all exposed to the fuel pressure of fuel inlet 38.

When control valve 66 moves away from valve seat surface 86 check control chamber 74 is fluidly connected to fuel drain outlet 40 and low pressure by way of drain orifice 80. With pressure reduced in control chamber 74, outlet check 46 is moved from its closed position to an open position, where nozzle outlets 44 are fluidly connected to nozzle cavity 42, to spray a fuel from nozzle outlets 44. As outlet check 46 lifts it will tend to retract either into contact with valve seat orifice plate 70, or to a position just spaced from valve seat orifice plate 70 where outlet check 46 hovers. In either case, it is generally desirable to provide outlet check 46 with a relatively soft stop at its fully open position. From the open position, control valve 66 is returned to its closed position, such as where electrical actuator 62 is deenergized and a return spring pushes rod piece 67 down to close control valve 66. With control valve 66 now closed, pressure can rises in control chamber 74 and will act upon closing hydraulic surface 72 to return outlet check 46 to its closed position. Re-pressurizing control chamber 74 may occur with flows of fuel through first re-pressurization orifice 96 and second re-pressurization orifice 98. A first flow of fuel from first re-pressurization orifice 96 is supplied at a radially outward location and a second flow of fuel from second re-pressurization orifice 98 is provided at a radially inward location. As discussed above, second re-pressurization orifice 98 may open to drain orifice 80, such that the second flow of fuel is conveyed to control chamber 74 through inlet end 100 of drain orifice 80.

Figure 15:
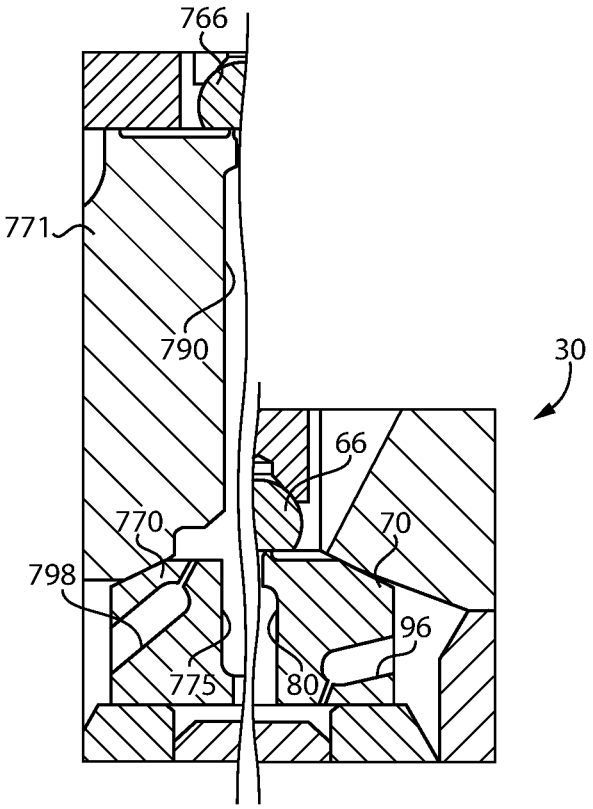
FIG. 15 is a comparative view of a portion of a fuel injector according to the present disclosure, in comparison to a known fuel injector design.

Referring now to FIG. 15, there is shown valve seat orifice plate 70 and other components of fuel injector 30 on the righthand side of the drawing in comparison to components in a known fuel injector, on the left hand side of the drawing. Those skilled in the art will be familiar with the terminology of F, A, E, and Z-orifices. According to the present disclosure, drain orifice 80, and analogous orifices in other embodiments, may be understood as an E-orifice, whereas first re-pressurization orifice 96 may be understood as a Z-orifice and second re-pressurization orifice 98 may be understood as an F-orifice. In the known system, an orifice plate 770 is provided having a drain orifice 778 that fluidly connects to another drain orifice 790 formed in a second component, namely, a valve seat plate 771. A fill orifice 798 is also formed in the orifice plate 770. A control valve 766 in the known system closes and opens drain orifice 790. It can also be noted that drain orifice 775 in orifice plate 770 is flow restricted at an inlet end, and drain orifice 790 in valve seat plate 771 is flow restricted at an outlet end. Those skilled in the art will recognize drain orifice 790 as an E-orifice, and drain orifice 775 as an A-orifice. According to the present disclosure a separate valve seat plate can be eliminated, and no A-orifice required at all. In this way, a reduced number of components and simplification of a fuel injector over the known design depicted, and others, is realized.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

an injector housing defining a longitudinal axis and having formed therein a fuel inlet, a fuel drain outlet, a nozzle cavity fluidly connected to the fuel inlet, and a plurality of nozzle outlets;

an outlet check movable from a closed position blocking the plurality of nozzle outlets from the nozzle cavity, to an open position, and having a closing hydraulic surface;

a valve seat orifice plate including a first axial side having a valve seat surface, a second axial side, and an outer surface axially between the first axial side and the second axial side and exposed to a fluid pressure of the fuel inlet;

the valve seat orifice plate further including a drain orifice extending between the valve seat surface and a check control chamber defined in part by each of the closing hydraulic surface and the second axial side, and a first re-pressurization orifice and a second re-pressurization orifice each opening in the outer surface and extending between the outer surface and the check control chamber; and an injection control valve assembly including an electrical actuator, an armature, and an injection control valve movable from a closed position in contact with the valve seat surface, to an open position fluidly connecting the drain orifice to the fuel drain outlet;

wherein the first re-pressurization orifice includes an inlet end formed in the outer surface, and an outlet end formed in the second axial side, and the second re-pressurization orifice includes an inlet end formed in the outer surface, and an outlet end directly fluidly connected to the drain orifice.

2. The fuel injector of claim 1 wherein:

the drain orifice is centrally located in the valve seat orifice plate and intersected by the longitudinal axis; and the drain orifice includes an unrestricted inlet end opening to the second axial side, and a restricted outlet end opening to a counterbore formed in the first axial side.

3. The fuel injector of claim 2 wherein the valve seat surface is flat and extends circumferentially around the counterbore.

4. The fuel injector of claim 3 wherein the injection control valve includes a flat-sided ball valve having a flat in contact with the valve seating surface.

5. The fuel injector of claim 3 wherein the counterbore is conical.

6. The fuel injector of claim 2 wherein the first axial side includes a plurality of flow slots distributed circumferentially around the longitudinal axis and extending radially outward from the valve seating surface.

7. The fuel injector of claim 2 wherein the first re-pressurization orifice is fluidly connected to the check control chamber at a location that is radially outward, relative to the longitudinal axis, and the second re-pressurization orifice is fluidly connected to the check control chamber at a location that is radially inward, relative to the longitudinal axis.

8. The fuel injector of claim 7 wherein the first re-pressurization orifice and the second re-pressurization orifice each include an unrestricted inlet end opening in the outer surface, and a restricted outlet end opposite to the unrestricted inlet end.

9. The fuel injector of claim 8 wherein the restricted outlet end of the second re-pressurization orifice opens to the drain orifice.

10. The fuel injector of claim 1 wherein the first axial side includes a profiled sealing surface extending circumferentially around the valve seating surface, and the fuel injector further includes an injector body piece in contact with the profiled sealing surface, and a check sleeve guiding the outlet check and in contact with the second axial side.

11. A fuel injector comprising:

an injector housing defining a longitudinal axis and having formed therein a fuel inlet, a fuel drain outlet, and a plurality of nozzle outlets;

an outlet check movable from a closed position blocking the plurality of nozzle outlets, to an open position, and having a closing hydraulic surface;

an injection control valve assembly; and a valve seat orifice plate including a first axial side having a valve seat surface, a second axial side, and an outer surface axially between the first axial side and the second axial side;

the valve seat surface is in contact with an injection control valve of the injection control valve assembly, and the outlet check includes a closing hydraulic surface facing the second axial side;

the valve seat orifice plate further including a drain orifice extending between the valve seat surface and a check control chamber defined in part by each of the closing hydraulic surface and the second axial side; and the valve seat orifice plate further including a first re-pressurization orifice and a second re-pressurization orifice each extending from an inlet end formed in the outer surface to an outlet end fluidly connected to the check control chamber.

12. The fuel injector of claim 11 wherein each respective inlet end includes an unrestricted inlet end, and each respective outlet end includes a restricted outlet end.

13. The fuel injector of claim 11 wherein the outlet end of the first re-pressurization orifice is located radially outward of the outlet end of the second re-pressurization orifice.

14. The fuel injector of claim 13 wherein the outlet end of the first re-pressurization orifice opens directly to the second axial side.

15. The fuel injector of claim 13 wherein the outlet end of the second re-pressurization orifice opens directly to the drain orifice.

16. The fuel injector of claim 11 wherein the valve seat orifice plate further includes a valve seat surface, and a plurality of flow slots distributed circumferentially around the longitudinal axis and extending radially outward of the valve seat surface.

17. The fuel injector of claim 16 wherein each of the plurality of flow slots is relatively deeper at locations radially inward and adjacent to the valve seat surface, and relatively shallower at locations radially outward.

18. The fuel injector of claim 16 wherein the valve seat orifice plate includes a profiled sealing surface upon the first axial side extending circumferentially around the valve seat surface and clamped in sealing contact with the injector housing.

19. A fuel injector comprising:

an injector housing defining a longitudinal axis and having formed therein a fuel inlet, a fuel drain outlet, and a plurality of nozzle outlets;

an outlet check movable from a closed position blocking the plurality of nozzle outlets, to an open position, and having a closing hydraulic surface;

an injection control valve assembly; and a valve seat orifice plate including a first axial side having a valve seat surface, a second axial side, and an outer surface axially between the first axial side and the second axial side;

the valve seat orifice plate further including a drain orifice extending between the valve seat surface and a check control chamber defined in part by each of the closing hydraulic surface and the second axial side; and the valve seat orifice plate further including a first re-pressurization orifice formed therein and fluidly connecting to the check control chamber at a radially inward location, and a second re-pressurization orifice formed therein and fluidly connecting to the check control chamber at a radially outward location;

wherein the first re-pressurization orifice includes an inlet end formed in the outer surface, and an outlet end formed in the second axial side, and the second re-pressurization orifice includes an inlet end formed in the outer surface, and an outlet end directly fluidly connected to the drain orifice.

* * * * *